US006416582B2

(12) United States Patent
Falck et al.

(10) Patent No.: US 6,416,582 B2
(45) Date of Patent: Jul. 9, 2002

(54) LIQUID USAGE DETECTOR FOR A COATING APPARATUS

(75) Inventors: Michael E. Falck, Wanatah; Norbert A. Satkoski, Union Mills, both of IN (US)

(73) Assignee: Roll Coater, Inc., Greenfield, IN (US)

( * ) Notice: Subject to any disclaimer, the term of this patent is extended or adjusted under 35 U.S.C. 154(b) by 0 days.

(21) Appl. No.: 09/785,782

(22) Filed: Feb. 16, 2001

Related U.S. Application Data

(60) Provisional application No. 60/183,065, filed on Feb. 16, 2000, and provisional application No. 60/223,745, filed on Aug. 8, 2000.

(51) Int. Cl.[7] ..... B05C 11/00

(52) U.S. Cl. ..... 118/679; 118/693; 118/694; 118/712

(58) Field of Search ..... 118/693, 694, 118/682, 679, 710, 712, 683, 684, 685; 222/64; 137/386

(56) References Cited

U.S. PATENT DOCUMENTS 4,545,323 A * 10/1985 Keys ..... 118/268
4,604,300 A 8/1986 Keys et al.
5,029,553 A * 7/1991 Cox ..... 118/674
5,419,732 A * 5/1995 Kaneko et al. ..... 451/28
5,549,752 A 8/1996 Hahn et al.
5,599,502 A * 2/1997 Miyazaki et al. ..... 422/82.01
5,695,817 A * 12/1997 Tateyama et al. ..... 427/240
5,985,028 A 11/1999 Cornell et al.
6,013,312 A 1/2000 Cornell et al.

OTHER PUBLICATIONS

The Flow and Level Handbook, Omega Engineering, Inc., vol. 29, 1995, pp. K–3 –K–4, K–23.*

* cited by examiner

*Primary Examiner*—Richard Crispino
*Assistant Examiner*—Kevin P Shortsle
(74) *Attorney, Agent, or Firm*—Barnes & Thornburg

(57) ABSTRACT

A coating apparatus includes a supply unit containing liquid coating material and a reservoir receiving liquid coating material dispensed from the supply unit. A coater dispenses liquid coating material onto a moving strip of material. A liquid meter unit includes a flow passage and a flow regulator associated with the flow passage. A flow rate manager cooperates with the reservoir to determine the flow rate of liquid coating material passing through the flow passage in the liquid meter unit and operates the flow regulator to regulate the flow rate of liquid coating material discharged to the coater.

20 Claims, 6 Drawing Sheets

LIQUID USAGE DETECTOR FOR A COATING APPARATUS

This application claims priority under 35 U.S. C. §119(e) to U.S. Provisional Application Serial No. 60/183,065, filed Feb. 16, 2000 and U.S. Provisional Application Serial No. 60/223,745, filed Aug. 8, 2000, which are expressly incorporated by reference herein.

BACKGROUND AND SUMMARY OF THE INVENTION

The present invention relates to a coating apparatus, and particularly to an apparatus for coating strip material. More particularly, the present invention relates to a liquid coating material usage detector in a metal strip coating apparatus.

Coating apparatus are configured to apply a coating onto material. See, for example, U.S. Pat. No. 6,013,312 to Cornell et al., U.S. Pat. No. 5,985,028 to Cornell et al., U.S. Pat. No. 5,549,752 to Hahn et al., and U.S. Pat. No. 4,604,300 to Keys et al.

A coating apparatus includes a coater configured to dispense liquid coating material onto a moving strip of material, a supply unit containing liquid coating material to be dispensed to the coater, a reservoir positioned to receive liquid coating material dispensed from the supply unit, and a liquid meter unit including a flow passage and a flow regulator associated with the flow passage. The coating apparatus further includes flow rate manager means for supplying liquid coating material to be dispensed to the reservoir to fill the reservoir to a desired level and for changing a flow rate of liquid coating material discharged from the liquid meter unit to the coater to match a predetermined flow rate specification by determining the flow rate of liquid coating material passing through the flow passage formed in the liquid meter unit and operating the flow regulator to regulate the flow rate of liquid coating material discharged to the coater.

In preferred embodiments, the flow rate manager means includes a proximity sensor which cooperates with the reservoir to detect the flow rate of the liquid coating material. The reservoir is cylinder-shaped and is formed to include an opening at its upper end, a coating material inlet, and a coating material outlet. The supply unit fills the reservoir with liquid coating material intermittently through the coating material inlet. When the liquid coating material in the reservoir reaches an upper level, the supply unit ceases filling the reservoir to begin the process of measuring the flow rate.

The sensor is mounted to the upper end of the reservoir and sends a first signal through the opening of the reservoir to sense a decreasing level of liquid coating material in the reservoir as the liquid coating material discharges from the reservoir through the coating material outlet. The sensor provides a second signal indicative thereof to the controller. The controller determines the flow rate of the liquid coating material based on the second signal. The inside diameter of the reservoir is small enough to provide sufficient resolution of changes in the level of the liquid coating material in the reservoir.

Additional features of the present invention will become apparent to those skilled in the art upon consideration of the following detailed description of the invention.

BRIEF DESCRIPTION OF THE DRAWINGS

The detailed description particularly refers to the accompanying figures in which.

DETAILED DESCRIPTION OF THE DRAWINGS

Figure 1:
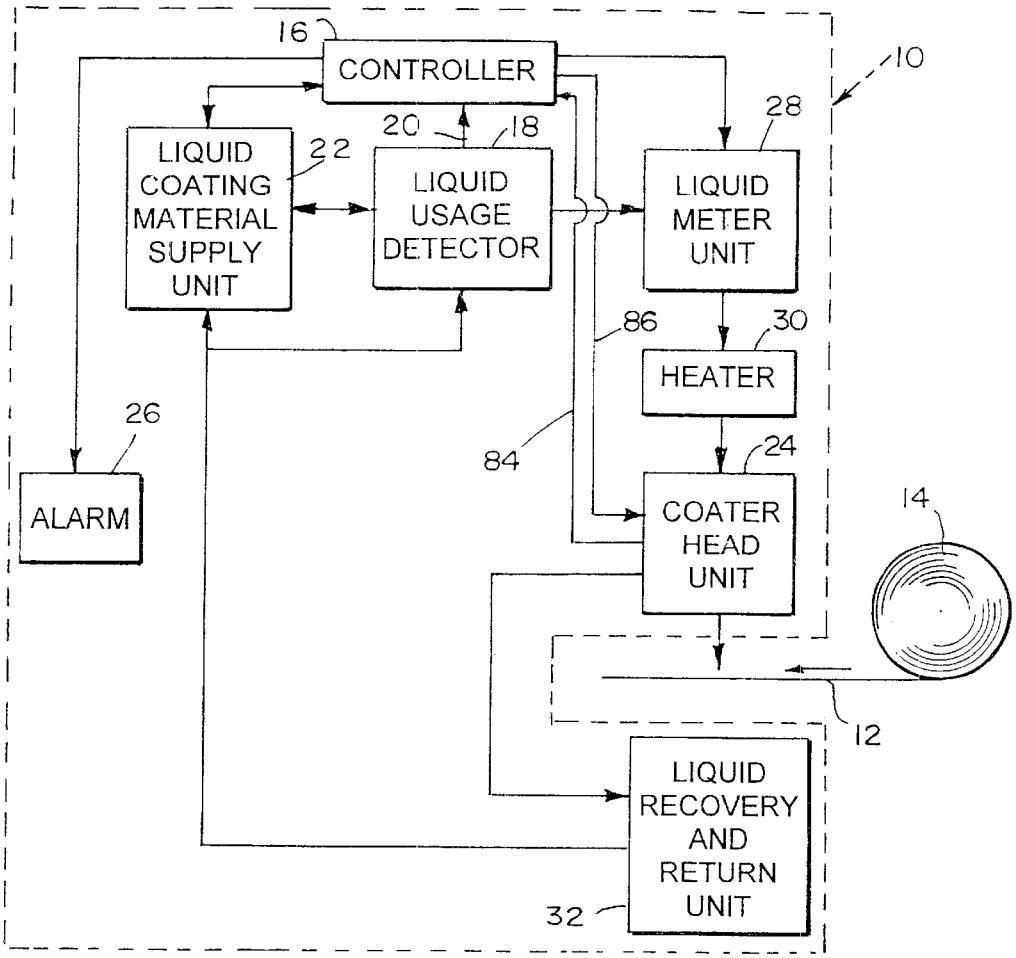
FIG. 1 is a diagrammatic view of a metal strip coating apparatus configured to apply a metered amount of a liquid coating material to a moving metal strip provided by a metal strip supply, the coating apparatus including a controller configured to control the application of liquid coating material onto the moving metal strip and a liquid usage detector configured to detect the rate the coating apparatus is using the liquid coating material (i.e., the actual usage rate) and to provide a variable, analog signal indicative thereof to the controller so that the controller can calculate the actual usage rate and perform closed-loop feedback control of the coating apparatus.

A metal strip coating apparatus 10 is configured to apply a metered amount of a liquid coating material to a moving metal strip 12 provided by a metal strip supply 14, as shown in FIG. 1. Coating apparatus 10 includes a controller 16, preferably a programmable logic controller, configured to control the application of liquid coating material onto moving metal strip 12 and a liquid usage detector 18 configured to detect the actual volumetric rate coating apparatus 10 is using liquid coating material over time (i.e., the volumetric flow rate referred to herein as the "actual usage rate") and to provide a variable, analog signal 20 indicative thereof to controller 16 so that controller 16 can calculate the actual usage rate of liquid coating material. Controller 16 then compares the actual usage rate to a desired usage rate to perform closed-loop feedback control of coating apparatus 10.

Coating apparatus 10 further includes a liquid coating material supply unit 22, a coater or coater head unit 24, and an alarm 26. Liquid supply unit 22 includes a transfer pump 92 coupled to controller 16 and a heater (not shown) so that liquid supply unit 22 is configured to pump heated liquid coating material directly to liquid usage detector 18 intermittently at the direction of controller 16 for ultimate application to moving metal strip 12. Coater head unit 24 is coupled to controller 16 and configured to apply liquid coating material directly to moving metal strip 12. Alarm 26 is coupled to controller 16 and configured to alert an operator when the actual usage rate of liquid coating material is outside of a predetermined usage rate range.

Between liquid supply unit 22 and coater head unit 24, liquid coating material flows generally, in series, through liquid usage detector 18, a liquid meter unit 28 configured to meter the amount of liquid coating material provided to coater head unit 24, and an inline heater 30 configured to heat liquid coating material (in addition to the heating provided by supply unit 22) to a predetermined temperature to facilitate "flash drying" of liquid coating material when it is applied to moving metal strip 12. Liquid meter unit 28 and heater 30 are included within coating apparatus 10. Liquid usage detector 18, liquid meter unit 28, and heater 30 are coupled to controller 16. Liquid usage detector 18 is coupled to liquid supply unit 22 and liquid meter unit 28 for fluid communication. Liquid meter unit 28 is coupled to liquid usage detector 18 and heater 30 for fluid communication. Heater 30 is coupled to liquid meter unit 28 and coater head unit 24 for fluid communication.

Liquid meter unit 28 is configured to regulate the actual flow rate of liquid coating material. Liquid meter unit 28 includes flow passage 88 and a flow regulator 90 associated with flow passage 88, as shown, for example, in FIGS. 7–9.

Figure 7:
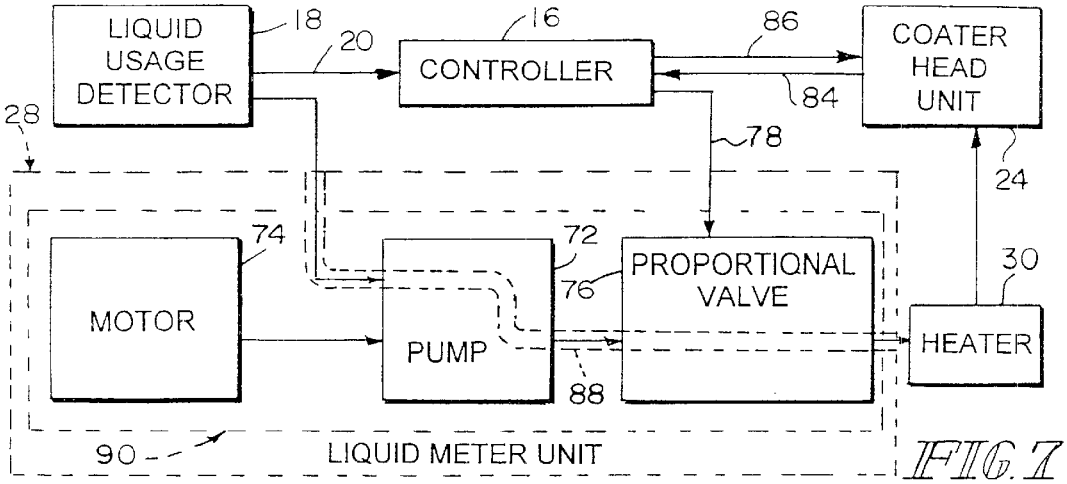
FIG. 7 is a diagrammatic view of the liquid meter unit of FIG. 1 showing the liquid meter unit including a pump coupled to the liquid usage detector for fluid communication to deliver liquid coating material to the coater head unit at a constant pressure, a motor coupled to the pump to drive the pump, and a proportional valve coupled to the controller and the pump to regulate the volume of liquid coating material delivered to the moving metal strip.

Flow regulator 90 includes a single centrifugal pump 72, a motor 74 coupled to pump 72 to drive pump 72, and a single proportional valve 76 coupled to controller 16 and to pump 72 for fluid communication, as shown in FIG. 7. Pump 72 is sized to operate at the top of the performance curve to deliver liquid coating material to coater head unit 24 from liquid usage detector 18 at a constant pressure regardless of fluctuations in the demand for liquid coating material due to width changes in moving metal strip 12. Using single centrifugal pump 72 limits equipment and installation cost of coating apparatus 10, complexity of coating apparatus 10, the amount of piping necessary for coating apparatus 10, the cost to maintain coating apparatus 10, and the risk of liquid coating material leaks. Proportional valve 76 regulates the volume of liquid coating material delivered to moving metal strip 12 based on a signal 78 from controller 16.

Figure 8:
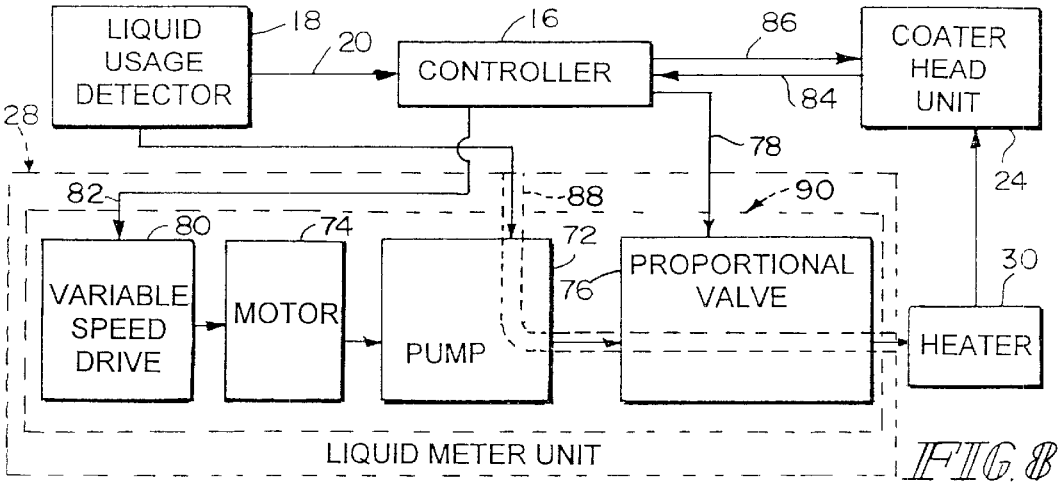
FIG. 8 is an alternative embodiment of the liquid meter unit of FIG. 7 showing the liquid meter unit including the pump, the motor, the proportional valve, and a variable speed drive coupled to the controller and the motor to regulate the volume of liquid coating material delivered to moving metal strip in addition to the proportional valve.
Figure 9:
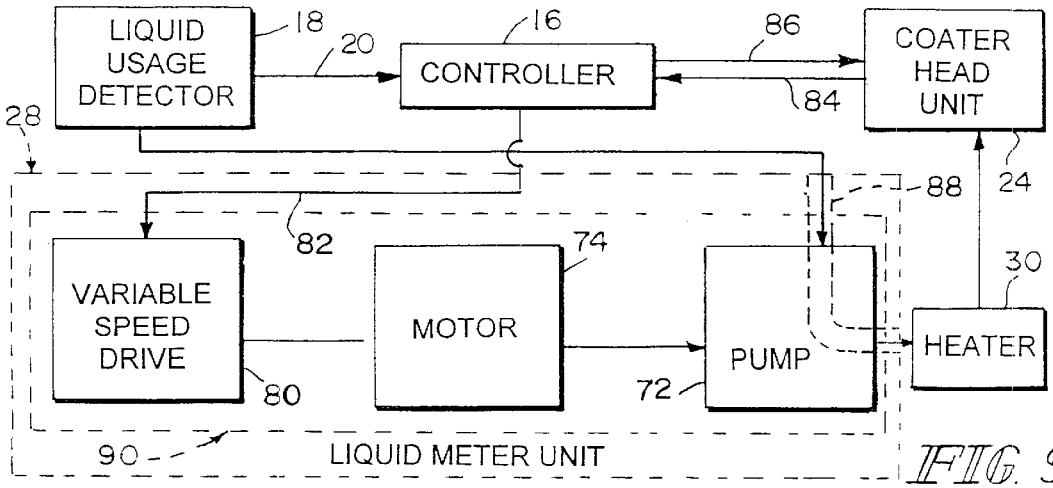
FIG. 9 is yet another alternative embodiment of the liquid meter unit of FIG. 7 showing the liquid meter unit including the pump, the motor, and the variable speed drive without the proportional valve.

In preferred embodiments, flow regulator 90 includes a variable speed drive 80 in addition to or in place of proportional valve 76, as shown, for example, in FIGS. 8–9. Variable speed drive 80 is coupled to controller 16 and to motor 74 to regulate the volume of liquid coating material delivered to moving metal strip based on a signal 82 from controller 16.

Coating apparatus 10 further includes a liquid recovery and return unit 32 configured to limit wastage of liquid coating material. Liquid recovery and return unit 32 recovers excess liquid coating material from coater head unit 24. During operation of coating apparatus 10, liquid recovery and return unit 32 returns the excess liquid coating material to liquid usage detector 18 for recycling. During purging and cleaning of coating apparatus 10, liquid recovery and return unit 32 directs the excess liquid coating material to liquid supply unit 22.

Figure 2:
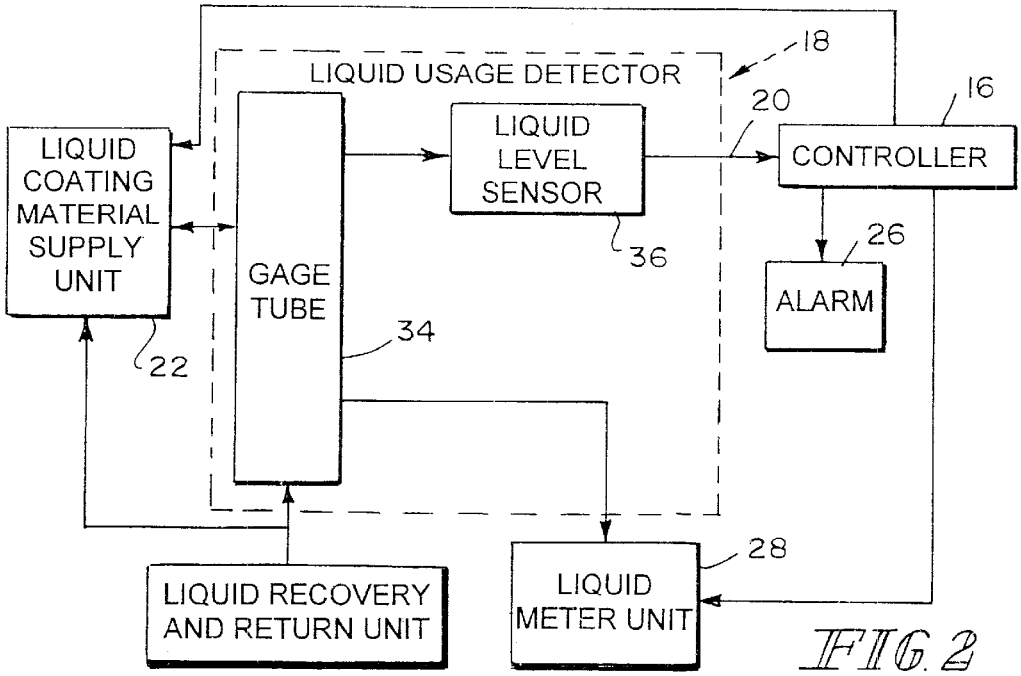
FIG. 2 is a diagrammatic view of the liquid usage detector of FIG. 1 showing the liquid usage detector including a gage tube and a liquid level sensor, the gage tube being configured to contain liquid coating material and coupled to a liquid coating material supply unit, a liquid meter unit, and a liquid recovery and return unit for fluid communication, and the liquid level sensor being coupled to the gage tube and the controller to provide a signal indicative of the liquid coating material inside of the gage tube.

Liquid usage detector 18 includes a reservoir or gage tube 34 and a liquid level sensor 36, as shown in FIG. 2. Gage tube 34 is configured to contain liquid coating material so that the level of a horizontal, top surface 40 of liquid coating material inside of gage tube 34 rises and falls in a generally cyclical manner in a sufficiently measurable way to enable controller 16 to calculate the actual usage rate of liquid coating material. Stated otherwise, gage tube 34 is configured to establish a change in the level of open, top surface 40 of liquid coating material inside of gage tube 34 as liquid coating material flows through gage tube 34 at the actual flow rate.

Gage tube 34 is coupled to liquid supply unit 22, liquid meter unit 28, and liquid recovery and return unit 32 for fluid communication. Liquid level sensor 36 is mounted to gage tube 34 to measure the level of top surface 40 relative to liquid level sensor 36 and provide signal 20 indicative thereof to controller 16 continuously. Liquid level sensor 36 measures a variable distance 38 between liquid level sensor 36 and the level of top surface 40 continuously so that signal 20 is indicative of variable distance 38. In preferred embodiments, liquid level sensor 36 is an analog Q45U ultrasonic proximity sensor obtained from Banner Engineering Corporation of Minneapolis, Minn. A laser-type proximity sensor is within the scope of this disclosure. Liquid usage detector 18 further includes a base 42 mounted to a foundation (not shown) and a lower end 44 of gage tube 34 to stand gage tube 34 upright and a mounting bracket 46 coupled to an open upper end 48 of gage tube 34 and liquid level sensor 36 to mount liquid level sensor 36 to gage tube 34.

Figure 3:
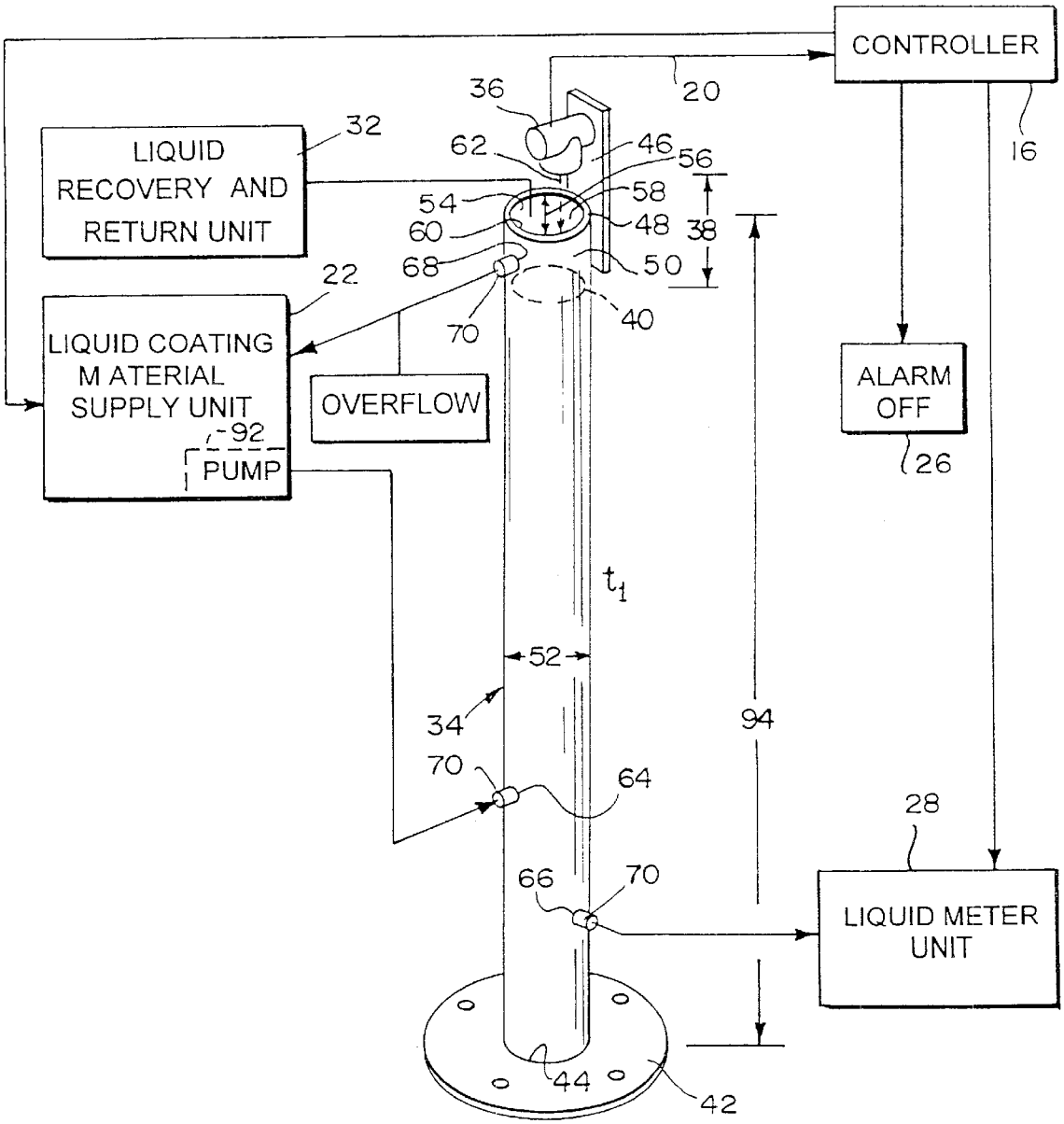
FIG. 3 is a perspective view of the liquid usage detector showing the gage tube having a cylindrical shape and a relatively small inner diameter to permit sufficient resolution of the level of a top surface (shown in phantom) of the liquid coating material therein by the liquid level sensor, and the liquid level sensor providing an analog signal indicative thereof to the controller at a time interval $t_1$.
Figure 4:
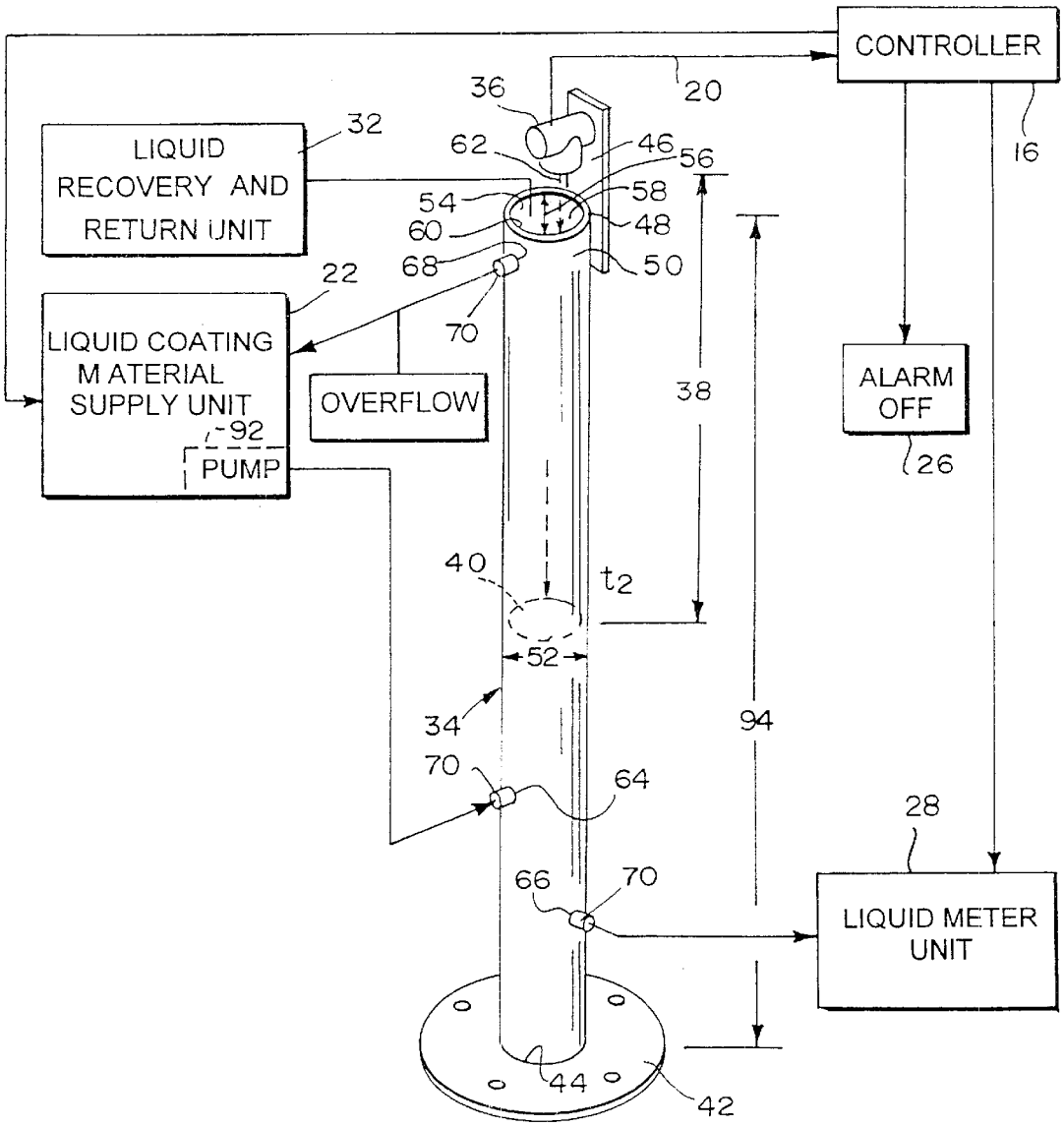
FIG. 4 is a perspective view of the liquid usage detector at a time interval $t_2$ showing the level of the liquid coating material (shown in phantom) in the gage tube having fallen relative to the level at $t_1$ shown in FIG. 3, and the actual usage rate being within a predetermined acceptable range as indicated by the alarm off condition.
Figure 5:
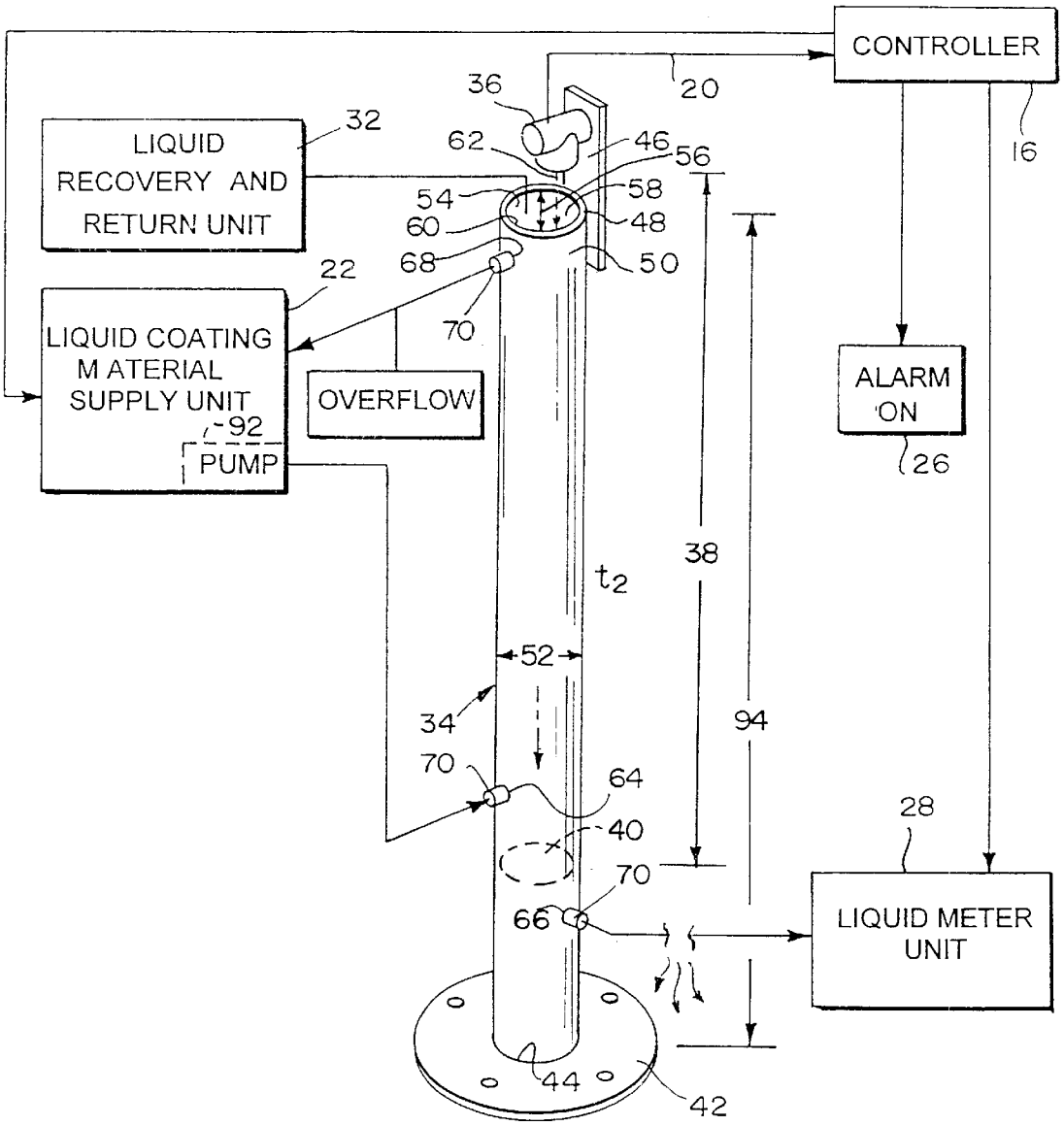
FIG. 5 is a perspective view of the liquid usage detector at another time interval $t_2$ showing the level of the liquid coating material (shown in phantom) in the gage tube having fallen relative to the level at $t_1$ shown in FIG. 3, and the actual usage rate being above a predetermined upper alarm threshold as indicated by the alarm on condition due to a possible leak somewhere in the coating apparatus.
Figure 6:
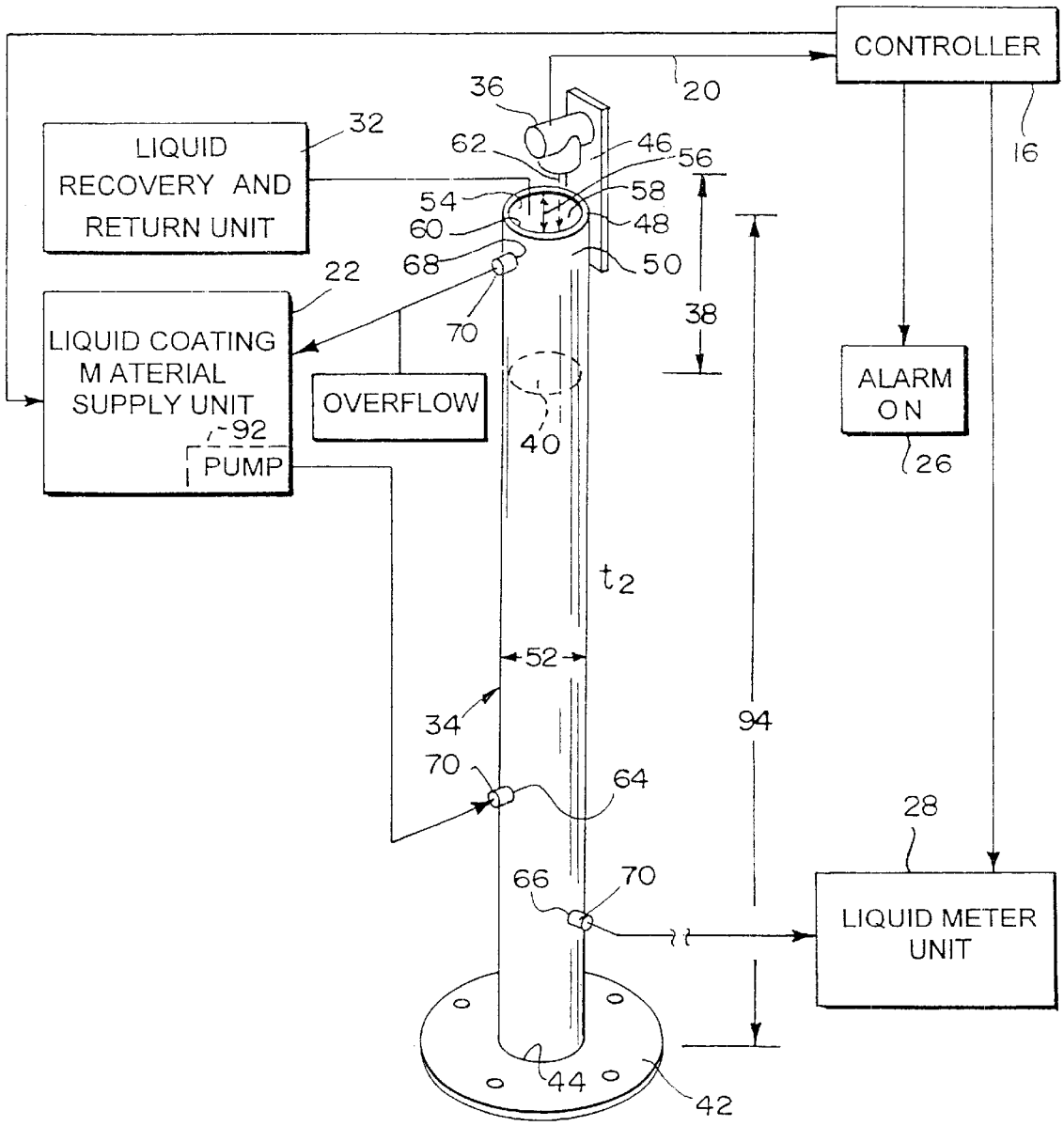
FIG. 6 is a perspective view of the liquid usage detector at another time interval $t_2$ showing the level of the liquid coating material (shown in phantom) in the gage tube having fallen relative to the level at $t_1$ shown in FIG. 3, and the actual usage rate being below a predetermined lower alarm threshold as indicated by the alarm on condition due to a possible blockage somewhere in the coating apparatus.

Gage tube 34 is cylinder-shaped and includes an outer surface 50 having an outer diameter 52 and an inner surface 54 having a relatively small inner diameter 56, as shown in FIG. 3. Gage tube 34 defines a height 94 between upper and lower ends 44, 48. Inner and outer surfaces 50, 54 cooperate to define gage tube 34 as annular-shaped in cross-section. Inner surface 54 defines an interior region 58 of gage tube 34 designed to be at least partially filled by liquid coating material. The cross-sectional area of interior region 58 between upper and lower ends 44, 48 is constant. Inner diameter 56 is sized to provide a relatively large level change of top surface 40 per unit of liquid coating material used by coating apparatus 10. Resolution of a level change of top surface 40 is a function of the size of inner diameter 56.

Open upper end 48 of gage tube 34 defines an opening 60 which opens into interior region 58. Upper end 48 is open so that liquid level sensor 36, which is positioned to lie outside of interior region 58, can direct an ultrasonic signal 62 through opening 60 toward top surface 40 to measure variable distance 38. Liquid recovery and return unit 32 pipes excess liquid coating material to opening 60 to drain into interior region 58 during operation of coating apparatus 10. In preferred embodiments, gage tube 34 is made of stainless steel or mild steel pipe, height 94 is about 40 inches (101.6 cm), and inner diameter 56 is about four inches (10.16 cm).

Gage tube 34 further includes an inlet 64, a first outlet 66, and an overflow drain or second outlet 68. Liquid coating material flows through inlet 64 into interior region 58 of gage tube 34 as liquid supply unit 22 supplies liquid coating material to gage tube 34 intermittently during operation of coating apparatus 10. Inlet 64 is positioned near lower end 44 above first outlet 66. First outlet 66 discharges liquid coating material from interior region 58 to liquid meter unit 28 continuously during operation of coating apparatus 10 and is positioned near lower end 44. Overflow drain or second outlet 68 is positioned near upper end 48 to drain liquid coating material from interior region 58 back to liquid supply unit 22 if interior region 58 becomes too full. Fittings 70 are coupled to inlet 64 and outlets 66, 68 to connect piping (not shown) to gage tube 34.

The level of top surface 40 rises and falls within interior region 58 in a generally cyclical fashion. A single cycle can be thought of as being divided into a relatively brief "filling stage" when gage tube 34 is filled with liquid coating material and a "measuring stage" when the actual usage rate of liquid coating material is determined. During the filling stage, the level of top surface 40 rises even though gage tube 34 continues to discharge liquid coating material through first outlet 66 to liquid meter unit 28 because liquid supply unit 22 supplies liquid coating material through inlet 64 to interior region 58 of gage tube 34. During the measuring stage, top surface 40 falls, as shown in FIGS. 3–6, because liquid supply unit 22 ceases to supply liquid coating material to interior region 58 of gage tube 34 and gage tube 34 continues to discharge liquid coating material through first outlet 66.

Controller 16 controls the cycling process of liquid coating material in gage tube 34. To start the filling stage, controller 16 directs transfer pump 92 of liquid supply unit 22 to supply liquid coating material to interior region 58 of gage tube 34 when controller 16 determines that the level of top surface 40 has reached a predetermined filling-stage start point, or measuring-stage end point, based on signal 20. Liquid supply unit 22 then fills interior region 58 with liquid coating material until the level of top surface 40 reaches a predetermined filling-stage end point, or measuring-stage start point, based on signal 20. Controller 16 then directs transfer pump 92 of liquid supply unit 22 to cease supplying liquid coating material to interior region 58 of gage tube 34 until the level of top surface 40 again reaches the filling-stage start point, or measuring-stage end point. Height 94 of gage tube 34 is a factor in how often transfer pump 92 must operate to fill gage tube 34. Height 94 is sufficiently long so that transfer pump 92 does not cycle on and off excessively.

Controller 16 determines the actual usage rate during the measuring stage. The actual usage rate is equal to the change in volume of liquid coating material in gage tube 34 per unit of time. To determine the change in volume of liquid coating material in gage tube 34 requires only measuring the change in the level of top surface 40 (i.e., the change in variable distance 38 per unit of time) since the cross-sectional area of interior region 58 is constant. Thus, the actual usage rate is determined by liquid level sensor 36 measuring the change of variable distance 38 per unit of time as top surface 40 falls within interior region 58 of gage tube 34.

The change of signal 20 is indicative of the change of variable distance 38 and, thus, the change of the level of top surface 40. Controller 16 monitors signal 20 continuously and records signal 20 at specific time intervals during the measuring stage. Controller 16 then calculates the actual usage rate based on the change of signal 20 between time intervals. At the end of each time interval, controller 16 calculates and records the actual usage rate for that time interval, thereby constantly updating the actual usage rate during the measuring stage. Controller 16 may update the calculated actual usage rate several times per measuring stage.

For example, at time interval $t_1$ during the measuring stage, liquid level sensor 36 provides signal 20 to controller 16 indicative of distance 38 between liquid level sensor 36 and the level of top surface 40 shown in FIG. 3 and controller 16 records this signal 20. At time interval $t_2$ during the measuring stage, liquid level sensor 36 provides signal 20 indicative of the distance between liquid level sensor 36 and the level of top surface 40 shown in FIG. 4, which has fallen between $t_1$ and $t_2$ due to the continuous discharge of liquid coating material from interior region 58 through first outlet 66. Controller 16 records signal 20 at time interval $t_2$. Controller 16 then calculates the actual usage rate based on the change in variable distance 38, and, thus, the change in the level of top surface 40, between time intervals $t_1$ and $t_2$. In preferred embodiments, the time that elapses between $t_1$ and $t_2$ is 20 seconds.

Inner diameter 52 is sized to permit sufficient resolution of the change of the level of top surface 40 during the measuring stage. The relatively small inner diameter 56 of gage tube 34 provides a large change in the level of top surface 40, or a large change in variable distance 38, for the amount of liquid coating material used per unit of time. The change in the level of top surface 40 in gage tube 34 is greater per unit of liquid coating material used than the change in the level of liquid coating material in a typical drum-type container. This allows for greater and faster resolution of the amount of liquid coating material being used and more accurate control of coating apparatus 10.

Controller 16 uses the calculated actual usage rate to perform closed-loop feedback control of coating apparatus 10. After controller 16 calculates the actual usage rate at the end of each time interval, controller 16 compares the actual usage rate to specific parameters selected based on the desired usage rate for the particular application of coating apparatus 10.

If the actual usage rate is above an upper tolerance threshold or below a lower tolerance threshold (i.e., deviates outside of a predetermined tolerance range), controller 16 adjusts liquid meter unit 28 to increase or decrease the actual usage rate to establish the actual usage rate within the predetermined tolerance range while coating apparatus 10 continues to operate. Controller 16 adjusts liquid meter unit 28 by sending signal 78 to proportional valve 76 to direct proportional valve 76 to regulate the actual usage rate of liquid coating material as required, as shown in FIG. 7. If liquid meter unit 28 includes variable speed drive 80 in addition to proportional valve 76, controller 16 also sends signal 82 to variable speed drive 80 to regulate the actual usage rate further, as shown in FIG. 8. If liquid meter unit 28 includes variable speed drive 80 without proportional valve 76, controller 16 sends signal 82 to variable speed drive 80 to regulate the actual usage rate but does not send signal 78, as shown in FIG. 9.

If the actual usage rate is above an upper alarm threshold or below a lower alarm threshold (i.e., deviates outside of the predetermined usage rate range) or if adjustment of liquid meter unit 28 by controller 16 cannot establish the actual usage rate within the predetermined tolerance range to correct the actual usage rate, controller 26 initiates alarm 26 while coating apparatus 10 continues to operate.

Controller 16 constantly monitors and adjusts the actual usage rate as required during operation of coating apparatus 10. Controller 16 is configured to adjust the output of liquid meter unit 28 based on an input signal (not shown) indicative of the speed of moving metal strip 12.

If the alarm condition is not corrected within a predetermined time, controller 16 shuts down coating apparatus 16. An actual usage rate that is too high could indicate a "leak" somewhere in coating apparatus 10, as shown at another time interval $t_2$, for example, in FIG. 5. Similarly, an actual usage rate that is too low could indicate a "blockage" somewhere in coating apparatus 10, as shown at yet another time interval $t_2$, for example, in FIG. 6. In addition, if the level of top surface 40 is below a shutdown threshold, such as below first outlet 66, controller 16 shuts down coating apparatus 10 to prevent pump 72 of liquid meter unit 28 from operating without any liquid coating material.

Gage tube 34 allows for precision use of liquid coating material and precision measurement of the actual usage rate of liquid coating material. The size of gage tube 34 is determined by the desired usage rate of liquid coating material and the resolution required to measure the actual usage rate. Coating apparatus 10 can detect very quickly when the actual usage rate is above or below the desired usage rate.

Coater head unit 24 includes a pressure transducer (not shown) that provides a signal 84 to controller 16 indicative of the pressure of liquid coating material in coater head unit 24. Controller 16 uses this pressure information in the control loop for controlling liquid meter unit 28 (i.e., for controlling the position of proportional valve 76 and/or variable speed drive 80, as the case may be).

Controller 16 sends signal 86 to coater head unit 24 to turn individual solenoids (not shown) on coater head unit 24 on and off in response to feedback from a sensor (not shown) configured to detect the position and width of moving metal strip 12. In preferred embodiments, this sensor is a light screen system obtained from Banner Engineering Corporation of Minneapolis, Minn. and generates a curtain of sensing beams of light to detect the position and width of moving metal strip 12. In other preferred embodiments, this sensor is a steering unit used to track the position and width of moving metal strip 12.

Although the invention has been described in detail with reference to preferred embodiments, variations and modifications exist within the scope and spirit of the invention as described and defined in the following claims.

What is claimed is:

1. A coating apparatus comprising a coater configured to dispense liquid coating material onto a moving strip of material, a supply unit containing liquid coating material to be dispensed to the coater, a reservoir positioned to receive liquid coating material dispensed from the supply unit, a liquid meter unit including a flow passage and a flow regulator associated with the flow passage, and flow rate manager means for supplying liquid coating material to be dispensed to the reservoir to fill the reservoir to a desired level and for changing a flow rate of liquid coating material discharged from the liquid meter unit to the coater to match a predetermined flow rate specification by determining the flow rate of liquid coating material passing through the flow passage formed in the liquid meter unit and operating the flow regulator to regulate the flow rate of liquid coating material discharged to the coater.

2. The coating apparatus of claim 1, wherein the flow rate manager means includes a controller and a sensor coupled to the controller, the reservoir includes an inner surface defining an interior region and an opening that opens into the interior region, and the sensor is mounted on the reservoir and configured to send a first signal through the opening to measure the level of the liquid coating material in the reservoir and to send a second signal indicative thereof to the controller.

3. The coating apparatus of claim 2, wherein the controller is configured to determine the flow rate of the liquid coating material passing through the flow passage based on changes in the second signal and to adjust the flow regulator to regulate the flow rate of liquid coating material discharged to the coater to match the flow rate specification.

4. The coating apparatus of claim 2, wherein the reservoir is cylinder-shaped and includes an upper end and a lower end, the reservoir stands upright on the lower end, the upper end defines the opening, and the sensor is mounted on the upper end of the reservoir.

5. The coating apparatus of claim 4, wherein the inner surface of the reservoir defines an inner diameter that is substantially constant between the upper end and the lower end.

6. The coating apparatus of claim 1, wherein the flow rate manager means includes a controller and a pump coupled to the controller and the controller is configured to direct the pump to dispense liquid coating material from the supply unit to fill the reservoir intermittently.

7. The coating apparatus of claim 1, wherein the flow regulator includes a pump and a proportional valve coupled to a controller.

8. The coating apparatus of claim 7, wherein the flow regulator includes a motor coupled to the pump and a variable speed drive coupled to the motor and the controller.

9. The coating apparatus of claim 1, wherein the flow regulator includes a pump, a motor coupled to the pump, and a variable speed drive coupled to the motor and the controller.

10. A coating apparatus comprising a liquid coating material supply unit configured to dispense a supply of liquid coating material, a coater configured to dispense the liquid coating material provided by the liquid coating material supply unit onto a moving strip of material, a controller, a flow regulator, a reservoir positioned to receive the liquid coating material provided by the liquid coating material supply unit, and sensing means for sensing the level of the liquid coating material in the reservoir and providing a first signal indicative thereof to the controller, the controller configured to adjust the flow regulator to regulate the actual flow rate of the liquid coating material to match a flow rate specification in response to the first signal.

11. The coating apparatus of claim 10, wherein the reservoir defines a length and includes an inner surface defining an inside diameter that is substantially constant along the length of the reservoir.

12. The coating apparatus of claim 11, wherein the ratio between the height and the inner diameter is about 10:1.

13. The coating apparatus of claim 10, wherein the reservoir is formed to include a coating material inlet, a coating material outlet, and an opening, and the sensing means includes a sensor positioned to send a second signal through the opening to measure the level of the liquid coating material in the reservoir.

14. The coating apparatus of claim 13, wherein the reservoir is cylinder-shaped and includes an upper end and a lower end, the reservoir stands upright on the lower end, the upper end defines the opening, and the sensor is mounted to the upper end of the reservoir.

15. The coating apparatus of claim 10, wherein the reservoir is positioned upstream of the flow regulator.

16. The coating apparatus of claim 10, wherein the sensing means includes one of an ultrasonic proximity sensor and a laser proximity sensor.

17. The coating apparatus of claim 10, wherein the liquid coating material supply unit includes a pump coupled to the controller and the controller is configured to direct the pump to dispense liquid coating material to fill the reservoir intermittently.

18. The coating apparatus of claim 17, wherein the controller is configured to direct the pump to dispense liquid coating material to fill the reservoir when the sensing means senses a lower level of liquid coating material in the reservoir.

19. The coating apparatus of claim 17, wherein the controller is configured to stop the pump from dispensing liquid coating material when the sensing means senses an upper level of liquid coating material in the reservoir.

20. A coating apparatus comprising a liquid coating material supply unit configured to dispense a supply of liquid coating material, a coater configured to dispense the liquid coating material provided by the liquid coating material supply unit onto a moving strip of material, a controller, a flow regulator, a gage tube positioned downstream of the liquid coating material supply unit and upstream of the flow regulator, the gage tube being cylinder-shaped and including an upper end, a lower end, and an inner surface defining an interior region and an inner diameter that is substantially constant between the upper end and the lower end, the gage tube formed to include a coating material inlet positioned to receive liquid coating material dispensed from the liquid coating material supply unit and a coating material outlet positioned to discharge liquid coating material from the interior region to the flow regulator, the upper end formed to include an opening into the interior region, the gage tube standing upright on the lower end, and a proximity sensor mounted on the upper end of the gage tube and configured to send a first signal through the opening into the interior region to sense the level of the liquid coating material in the gage tube and to provide a second signal indicative thereof to the controller, the controller configured to determine the actual flow rate of the liquid coating material discharging from the gage tube based on changes in the second signal and to adjust the flow regulator to regulate the actual flow rate to match a flow rate specification.

* * * * *